US011331819B2

(12) United States Patent
Huang

(10) Patent No.: US 11,331,819 B2
(45) Date of Patent: May 17, 2022

(54) PET SHAVER

(71) Applicant: Shenzhen zhongdaxin Epoxy plate Co. Ltd., Shenzhen (CN)

(72) Inventor: Shengwen Huang, Anxiang (CN)

( * ) Notice: Subject to any disclaimer, the term of this patent is extended or adjusted under 35 U.S.C. 154(b) by 0 days.

(21) Appl. No.: 16/898,464

(22) Filed: Jun. 11, 2020

(65) Prior Publication Data

US 2020/0298431 A1 Sep. 24, 2020

(30) Foreign Application Priority Data

May 27, 2020 (CN) ..... 202010464185.7

(51) Int. Cl.
*B26B 19/04* (2006.01)
*B26B 19/38* (2006.01)
*B26B 19/44* (2006.01)

(52) U.S. Cl.
CPC ..... *B26B 19/04* (2013.01); *B26B 19/3853* (2013.01); *B26B 19/44* (2013.01)

(58) Field of Classification Search
CPC ..... B26B 19/44; B26B 19/3853; B26B 19/04; B26B 19/38; A45D 44/16; A01K 13/00
USPC ..... 30/133, 41.5
See application file for complete search history.

(56) References Cited

U.S. PATENT DOCUMENTS 3,440,681 A * 4/1969 Wahl ..... B26B 19/44 15/339
2006/0059696 A1* 3/2006 Derby ..... B26B 19/06 30/210
2006/0230619 A1* 10/2006 Williams ..... B26B 19/44 30/133
2013/0145992 A1* 6/2013 Liang ..... A47L 9/0613 119/608
2019/0124885 A1* 5/2019 Pereira ..... A47L 9/242

FOREIGN PATENT DOCUMENTS

DE 2524494 A1 * 12/1976 ..... B26B 19/44
FR 2943937 B1 * 4/2011 ..... B26B 19/44
KR 2018034721 A * 4/2018 ..... A01K 13/00

OTHER PUBLICATIONS https://www.merriam-webster.com/dictionary/air%20duct.*
https://www.merriam-webster.com/dictionary/duct.*

* cited by examiner

*Primary Examiner* — Laura M Lee

(57) ABSTRACT

A pet shaver includes an outer shell, a cutter head module provided at a top end of the outer shell, an air duct and a connecting device. The outer shell has an accommodating space. A bottom end of the outer shell is connected to the connecting device. A top end of the air duct extends out of the outer shell and provided above the cutter head module, a bottom end of the air duct extends out of the outer shell and is accommodated in the connecting device, and the air duct is communicated with the connecting device.

10 Claims, 3 Drawing Sheets

PET SHAVER

TECHNICAL FIELD

The present invention relates to the technical field of a pet shaver, and particularly to a pet shaver capable of collecting shaved pet hair while shaving.

BACKGROUND

Existing pet shavers usually require manual operation. The shaved pet hair is easily scattered to other places. It is not easy to collect shaved pet hair, which may affect residential hygiene and affect the physical health of people.

Therefore, it is necessary to provide a pet shaver capable of collecting shaved pet hair while shaving pets.

SUMMARY

The object of the present invention is to provide a pet shaver to solve the problems mentioned in the background.

To achieve the above object, the present invention provides the following technical solutions:

a pet shaver, comprising an outer shell, an air duct and a connecting device, wherein the outer shell has an accommodating space, a bottom end of the outer shell is connected to the connecting device, the air duct is accommodated in the connecting device, and the air duct is communicated with the connecting device.

Preferably, the outer shell comprises an upper shell and a lower shell, the upper shell is connected to the lower shell, and the upper shell and the lower shell are combined to form an accommodating space.

Preferably, the bottom end of the upper shell has an opening, and in the assembled state, the bottom end of the air duct is communicated with the opening.

Preferably, the air duct and the upper shell are of an integrated structure.

Preferably, the connecting device comprises an abutment plate and a connecting part connected to the abutment plate, the abutment plate is abutted against the outer shell, and the connecting part is connected with a vacuum cleaner.

Preferably, the abutment plate has a communication hole, the communication hole is provided corresponding to the opening at the bottom end of the upper shell in the assembled state, and the air duct is capable of being communicated with the connecting part through the communication hole and the opening at the bottom end of the upper shell.

Preferably, the pet shaver further comprises a cutter head module, a power module and a control module, wherein the control module is electrically connected to the power module, the power module is connected to the cutter head module through a transmission part and is capable of driving the cutter head module to move, and the cutter head module is provided at the top end of the outer shell and is close to the top end of the air duct.

Preferably, the pet shaver further comprises a power supply module, wherein the power supply module is electrically connected to the control module and provides electric energy to the pet shaver.

Preferably, the pet shaver further comprises a switch module, wherein the switch module is electrically connected to the control module.

The pet shaver provided by the present invention is capable of absorbing the shaved hair while shaving the pet, preventing a large amount of hair from scattering, and reducing the workload of the user.

DESCRIPTION OF THE EMBODIMENTS

The technical solutions in the embodiments of the present invention will be described clearly and completely in conjunction with the drawings in the embodiments of the present invention. It is obvious that the described embodiments are only a part of the embodiments of the present invention, rather than all the embodiments. Based on the embodiments of the present invention, all other embodiments obtained by those skilled in the art without creative labor fall within the protection scope of the present invention.

Figure 1:
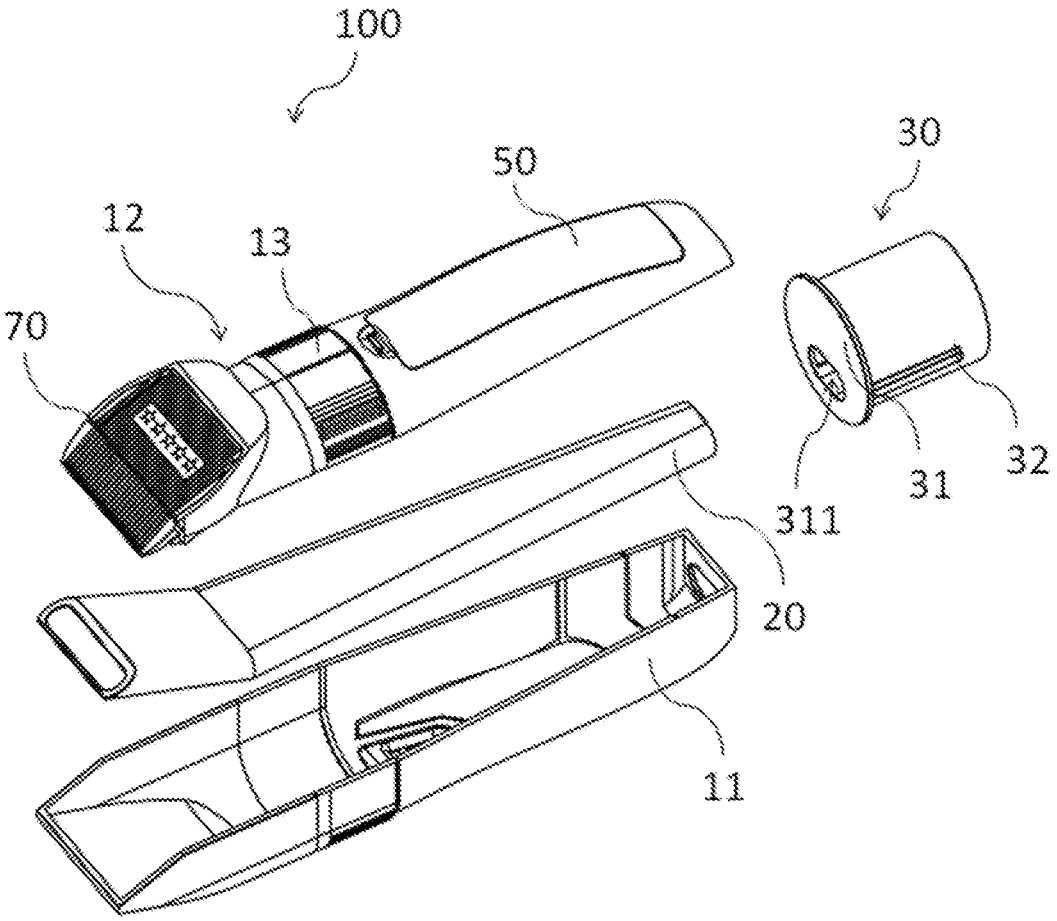
FIG. 1 is a schematic diagram of an exploded structure of a pet shaver according to the present invention.
Figure 2:
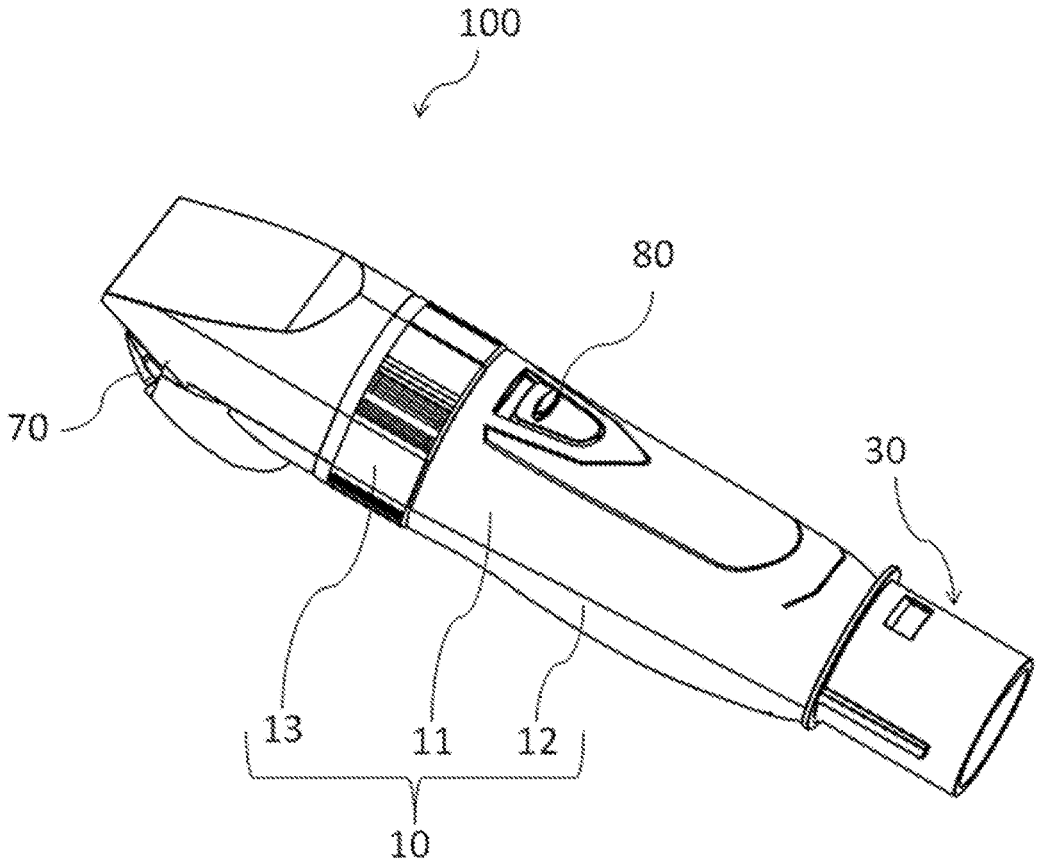
FIG. 2 is a schematic diagram of an assembly structure of a pet shaver shown in FIG. 1.
Figure 3:
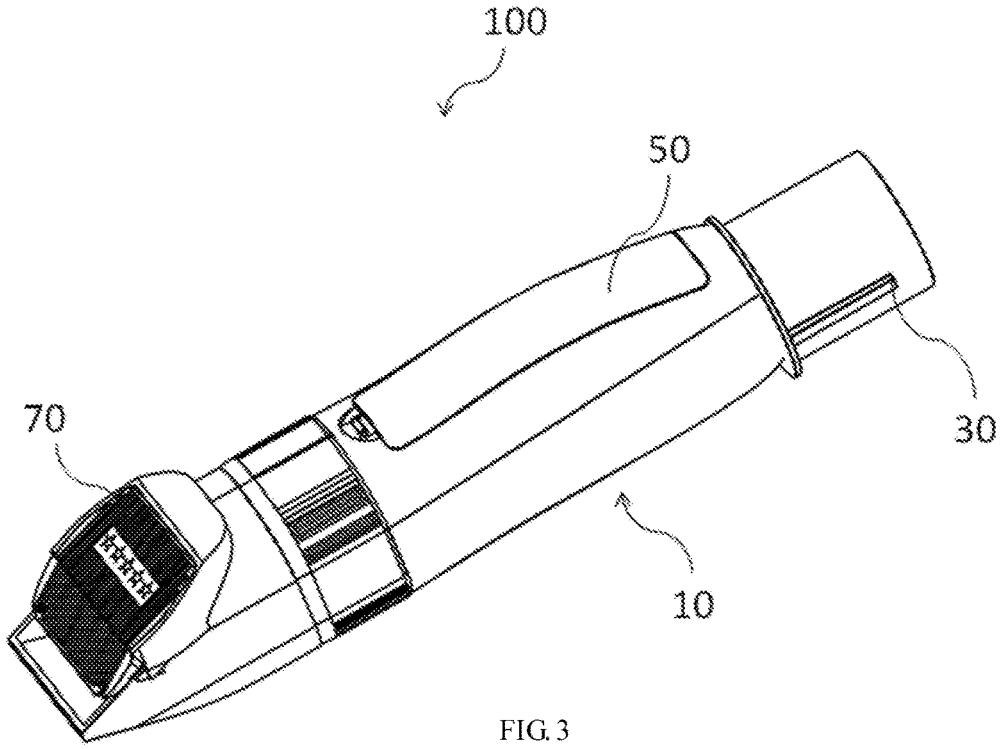
FIG. 3 is a schematic diagram of an assembly structure of a pet shaver shown in FIG. 1 from another perspective.
Figure 4:
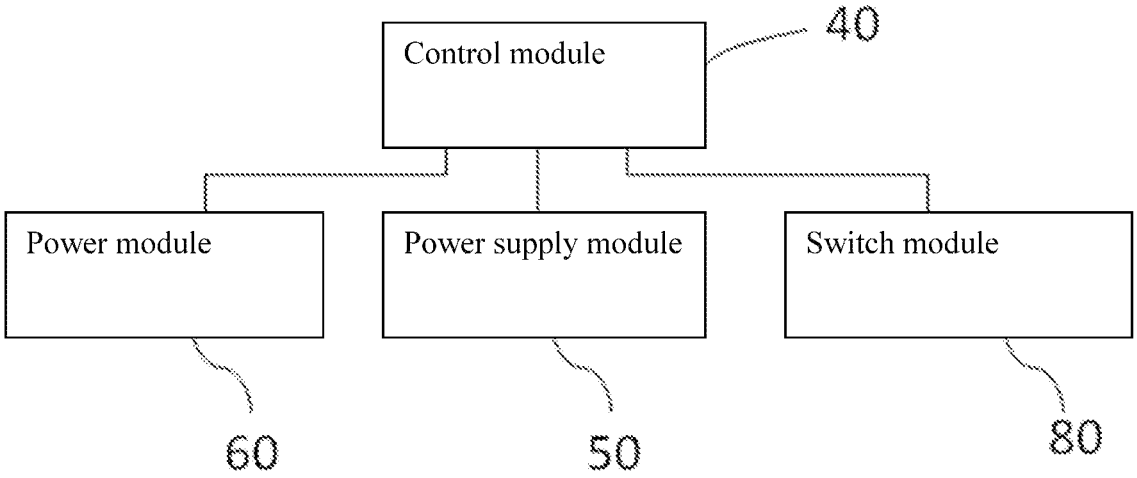
FIG. 4 is a schematic diagram of an electrical connection structure of a pet shaver shown in FIG. 1.

Refer to FIGS. 1-4 at the same time, wherein FIG. 1 is a schematic diagram of an exploded structure of a pet shaver according to the present invention; FIG. 2 is a schematic diagram of an assembly structure of a pet shaver shown in FIG. 1; FIG. 3 is a schematic diagram of an assembly structure of a pet shaver shown in FIG. 1 from another perspective; FIG. 4 is a schematic diagram of an electrical connection structure of a pet shaver shown in FIG. 1.

The pet shaver 100 comprises an outer shell 10, an air duct 20, a connecting device 30, a control module 40, a power supply module 50, a power module 60, a cutter head module 70, and a switch module 80. The outer shell 10 has an accommodating space, and the air duct 20, the control module 40, the power supply module 50 and the power module 60 are accommodated in the accommodating space. One end of the connecting device 30 is connected to the bottom end of the outer shell 10, and the other end thereof is connected to a vacuum cleaner. The cutter head module 70 is provided at the top end of the outer shell 10. The control module 40 is electrically connected to the power supply module 50, the power module 60 and the switch module 80, respectively.

The outer shell 10 comprises an upper shell 11, a lower shell 12 and a pattern adjusting component 13. The upper shell 11 and the lower shell 12 are combined to form an accommodating space. The pattern adjusting component 13 is sleeved on the outer shell 10. The outer shell 10 is generally of a quasi-cylindrical shape.

The upper housing 11 is generally of a semi-cylindrical shape. The bottom end of the upper shell 10 has an opening 111.

The lower shell 12 is combined and connected to the upper shell 11. Specifically, the upper shell 11 and the lower shell 12 are combined to form an accommodating space. The upper shell 11 and the lower shell 12 may be fixed by snapping or by screws, which is not limited in the present invention.

The pattern adjusting component 13 is provided in the middle of the outer shell 10. The pattern adjusting component 13 is connected to the cutter head module 70 through a transmission device (not shown), and can adjust the structure of the cutter head module 70 by adjusting the pattern adjusting component 13 so as to adjust the suitable pattern according to different types of pets.

The air duct 20 is provided in the outer shell 10. The inner part of the air duct 20 is communicated, and other parts other than openings at both ends have a sealed structure. In other words, the outer wall of the air duct 20 has a sealed structure. In the normal assembled state, the air duct 20 is accommodated in the accommodating space and is provided close to the upper shell 11. The top end thereof is close to the top end of the outer shell 10, and the width of the top thereof is adapted to the top end of the outer shell 10.

The bottom end of the air duct 20 passes through the opening 111 of the upper shell and is connected to the connecting device 30. In other words, the bottom end of the air duct 20 is communicated with the opening 111 of the upper shell. The air duct 20 may be a separate structure, or may be an integrated structure with the upper shell 11, which is not limited in the present invention. For convenience of description, the part of the accommodation space other than the air duct 20 is named as the main accommodation space.

One end of the connecting device 30 is connected to the vacuum cleaner, and the other end thereof is connected to the air duct 20 and is abutted against the outer shell 10 at the same time. The connecting device 30 comprises an abutment plate 31 and a connecting part 32. The abutment plate 31 is provided at the top end of the connecting part 32.

The connecting part 32 is configured to be connected with a vacuum cleaner. The vacuum cleaner may be an ordinary vacuum cleaner or a specially designed vacuum cleaner that can easily absorb pet hair. There are a plurality of connecting parts 32, and various types of different models can be set according to different types of vacuum cleaners, so as to adapt to various different vacuum cleaners. The structure of the connecting part 32 is a tubular structure.

The abutment plate 31 covers the connecting part 32. The abutment plate 31 has a flat sheet structure. The abutment plate 31 has a communication hole 311. The communication hole 311 is connected to the bottom end of the air duct 20, and realizes communication between the bottom end of the air duct 20 and the connecting part 32. In the assembled state, the communication hole 311 is corresponding to the opening 111 at the bottom end of the upper housing 11. Preferably, the communication hole 311 and the opening 111 have the same shape and are overlapped. The air duct 20 can be communicated with the connecting part through the communication hole 311 and the opening 111 at the bottom end of the upper shell 11.

The outer shell 10 is abutted against the abutment plate 31. Specifically, the bottom end of the upper shell 11 is abutted against the abutment plate 31; the bottom end of the lower shell 12 may be connected to the abutment plate 31 or may be spaced from the abutment plate 31 by a predetermined distance, which is not limited in the present invention.

The control module 40 is electrically connected to the power supply module 50, the power module 60, the cutter head module 70, and the switch module 80, respectively. The control module 40 can control the working state of the pet shaver 100 according to the received information.

The power supply module 50 is provided in the accommodating space. The power supply module 50 is electrically connected to the control module 40 and can provide electric energy to the electric appliance of the pet shaver 100. In this embodiment, the power supply module 50 is a lithium ion battery.

The power module 60 is electrically connected to the control module 40 and is connected to the cutter head module 70 through a transmission part (not shown). The working state of the power module 60 is controlled by the control module 40.

The cutter head module 70 is provided at the top end of the outer shell 10. Specifically, the cutter head module 70 is provided at the top end of the lower housing 10, and is connected to the power module 60 through a transmission part, and is driven to work by the power module 60. There may be also a plurality of cutter head modules 70.

The switch module 80 is provided on the outer shell 10. Specifically, the switch module 80 is provided on the surface of the upper shell 11. In addition, the switch module 80 is electrically connected to the control module 40. The switch module 80 not only can control the on/off of the pet shaver 100, but also control the working state and intensity of the pet shaver 100.

The vacuum cleaner is communicated with the air duct 20 through a pipeline, so that the pet hair can be absorbed. The vacuum cleaner may be an existing universal vacuum cleaner, which will not be described in detail in the present invention. In this embodiment, there may be a plurality of connecting devices 30. The specifications of the plurality of connecting devices 30 are different, so that it is convenient for the user to connect vacuum cleaners of different specifications.

In order to understand the working process of the pet shaver 100 more clearly, the working state of the pet shaver 100 will be described in detail below.

When it is necessary to shave pets, the pattern adjusting component 13 is first adjusted according to the length and type of pet hair, so that the cutter head module 70 is in the most suitable pattern.

Then, the pet shaver 100 is started through the switch module 80. Of course, the pet shaver 100 can also be started first through the switch module 80, and then the structure of the cutter head module 70 can be adjusted as needed.

During the process of shaving pets by the cutter head module 70, the vacuum cleaner is in an open state. The shaved pet hair will be drawn into the vacuum cleaner through the air duct 20 after being shaved, thereby conveniently reducing the workload of the user, and preventing a large amount of scattered pet hair from being cleaned. It can be understood that the air duct 20 is provided close to the cutter head module 70. Specifically, the opening at the top end of the air duct 20 is provided above the cutter head module 70. When the cutter head module 70 shaves the pet hair, the pet hair can be smoothly collected into the vacuum cleaner through the air duct 20.

The pet shaver 100 provided by the present invention is capable of absorbing the shaved hair while shaving the pet, preventing a large amount of hair from scattering, and reducing the workload of the user.

The specific embodiments of the present invention enable those skilled in the art to understand or implement the present invention. Various modifications to these embodiments will be apparent to those skilled in the art. The general principles defined herein may be implemented in other embodiments without departing from the spirit or scope of the present invention. Therefore, the present invention will not be limited to the embodiments shown herein, but should conform to the widest scope consistent with the principles and novel features of the present disclosure herein.

What is claimed is:

1. A pet shaver, comprising an outer shell, a cutter head module provided at a top end of the outer shell, an air guiding pipe and a connecting device, wherein the outer shell has an accommodating space, a bottom end of the outer shell is connected to the connecting device, the guiding pipe has an outer wall with two ends open, a top end of the air guiding pipe extends out of the outer shell and provided above the cutter head module, a bottom end of the air guiding pipe extends out of the outer shell and is accommodated in the connecting device, and the air guiding pipe is communicated with the connecting device.

2. The pet shaver according to claim 1, wherein the outer shell comprises an upper shell and a lower shell, the upper shell is connected to the lower shell, and the upper shell and the lower shell are combined to form the accommodating space.

3. The pet shaver according to claim 2, wherein the bottom end of the upper shell has an opening, and in the assembled state, the bottom end of the air guiding pipe extends through the opening.

4. The pet shaver according to claim 2, wherein the air guiding pipe and the upper shell are of an integrated structure.

5. The pet shaver according to claim 3, wherein the connecting device comprises an abutment plate and a connecting part connected to the abutment plate, the abutment plate is abutted against the outer shell, and the connecting part is connected with a vacuum cleaner and is communicated with the air guiding pipe.

6. The pet shaver according to claim 5, wherein the abutment plate has a communication hole, the communication hole is provided corresponding to the opening at the bottom end of the upper shell in the assembled state, and the air guiding pipe is capable of being communicated with the connecting part through the communication hole and the opening at the bottom end of the upper shell.

7. The pet shaver according to claim 1, further comprising a power module and a control module, wherein the control module is electrically connected to the power module, the power module is connected to the cutter head module through a transmission part and is capable of driving the cutter head module to move.

8. The pet shaver according to claim 7, further comprising a power supply module, wherein the power supply module is electrically connected to the control module and provides electric energy to the pet shaver.

9. The pet shaver according to claim 8, further comprising a switch module, wherein the switch module is electrically connected to the control module.

10. The pet shaver according to claim 2, wherein the air guiding pipe extends from the upper shell downwardly to be close to the cutter head module.

* * * * *